US005937552A

United States Patent [19]

Hall

[11] Patent Number: 5,937,552

[45] Date of Patent: Aug. 17, 1999

[54] IRON SOLEPLATE WITH A SOLEPLATE BOTTOM COVER

[75] Inventor: Stephen M Hall, Cheshire, Conn.

[73] Assignee: HP Intellectual Corp., Wilmington, Del.

[21] Appl. No.: 08/781,876

[22] Filed: Jan. 10, 1997

[51] Int. Cl.[6] ..... D06F 75/38

[52] U.S. Cl. ..... 38/93

[58] Field of Search ..... 38/93, 81, 88, 38/97, 94

[56] References Cited

U.S. PATENT DOCUMENTS

| | | | |
|---|---|---|---|
| 1,995,035 | 3/1935 | McArdale et al. | 38/93 X |
| 3,905,138 | 9/1975 | Abolafia | 38/97 |
| 4,642,922 | 2/1987 | Prudenziati | 38/81 |
| 4,658,520 | 4/1987 | Henneberger et al. | 38/93 |
| 4,822,686 | 4/1989 | Louison et al. | 428/457 |
| 4,837,952 | 6/1989 | Hennuy et al. | 38/77.7 |
| 5,613,309 | 3/1997 | Amsel et al. | 38/93 X |
| 5,664,349 | 9/1997 | White et al. | 38/97 |

FOREIGN PATENT DOCUMENTS

| | | | |
|---|---|---|---|
| 556721 | 8/1993 | European Pat. Off. | 38/93 |
| 500170 | 1/1951 | France . | |
| 1502451 | 11/1967 | France . | |
| 2701496 | 8/1994 | France . | |
| 9401094 | 1/1994 | Germany . | |
| 4316281 | 11/1994 | Germany . | |
| 2225345 | 5/1990 | United Kingdom . | |
| WO 94/17236 | 8/1994 | WIPO . | |
| WO 95/27819 | 10/1995 | WIPO . | |

*Primary Examiner*—Ismael Izaguirre
*Attorney, Agent, or Firm*—Barry E. Deutsch

[57] ABSTRACT

An iron having a soleplate with a soleplate base and a soleplate wrap. The base is a unitary metal member with a heating element therein. The wrap is a one-piece sheet metal member that is directly attached onto the base.

16 Claims, 3 Drawing Sheets

IRON SOLEPLATE WITH A SOLEPLATE BOTTOM COVER

BACKGROUND OF THE INVENTION

1. Field of the Invention

The present invention relates to irons and, more particularly, to a soleplate of an iron.

2. Prior Art

German Patent DE 4316281 discloses an ironing base of an electric iron with a cast metal base and a base plate. The base plate has two layers of different material. German Patent G 9401094.3 and PCT publication WO 94/17236 disclose a soleplate cover made from colaminate materials. PCT publication WO 95/27819 discloses a soleplate with a base glued to the body of the iron. The base has an aluminum oxide coating.

In the past, due to processing limitations in manufacturing plants, available soleplate appearances were usually restricted to satin (simply sanding the bottom of the soleplate), silverstone/non-stick (applied in the plant), and mirror/polished (multiple sanding and buffing operations of the aluminum soleplate itself). All of these secondary operations require the bottom of the casted soleplate to be free of imperfections. This is currently a high scrap issue in a manufacturing plant because any imperfections would be highlighted by the various finishes. If the imperfections could not be removed prior to finishing or during the finishing process, the casting would be either scrapped entirely or remelted to reclaim the aluminum and calrod. Either option adds cost to the product. All of these secondary operations add cost to the product as well as tie up valuable floor space which can be leveraged for manufacturing additional product. Also, a higher tooling cost results because of the need to keep the casting tool finish at a high level in order to maximize the appearance of the casting.

It is an object of the present invention to simplify the design and eliminate costly secondary operations of the soleplate by mechanically roll forming the outer edge of an aluminum, steel, and/or stainless steel wrap onto the soleplate. The wrap will then be the visible portion of the soleplate and can be coated with a variety of coatings or left as is to suit the desired needs of the marketplace.

SUMMARY OF THE INVENTION

In accordance with one embodiment of the present invention, an iron is provided having a housing, a soleplate connected to the housing, and means for heating the soleplate. The improvement comprises the soleplate having a unitary base member with a heating element therein and a one-piece wrap. The one-piece wrap is attached directly to the base member and covers a bottom surface of the base member.

In accordance with another embodiment of the present invention, an iron soleplate is provided comprising a first cast metal member and a second sheet metal member. The first cast metal member has a heating element extending therethrough. The second sheet metal member is connected to the first member and covers a bottom surface of the first member. The second sheet metal member has a thickness of between about 0.02 to about 0.03 inch such that heat from the first member is transferred quickly to the second member without a thermally conductive medium between the two members.

In accordance with another embodiment of the present invention, an iron is provided having a housing, a soleplate connected to the housing, and means for heating the soleplate. The improvement comprises the soleplate having a first metal member with a heating element therein and a second metal member connected to the first member. The second metal member covers a bottom surface of the first member. An air gap is provided between the bottom surface of the first member and the second member to provide even heat distribution from the first member to the second member.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
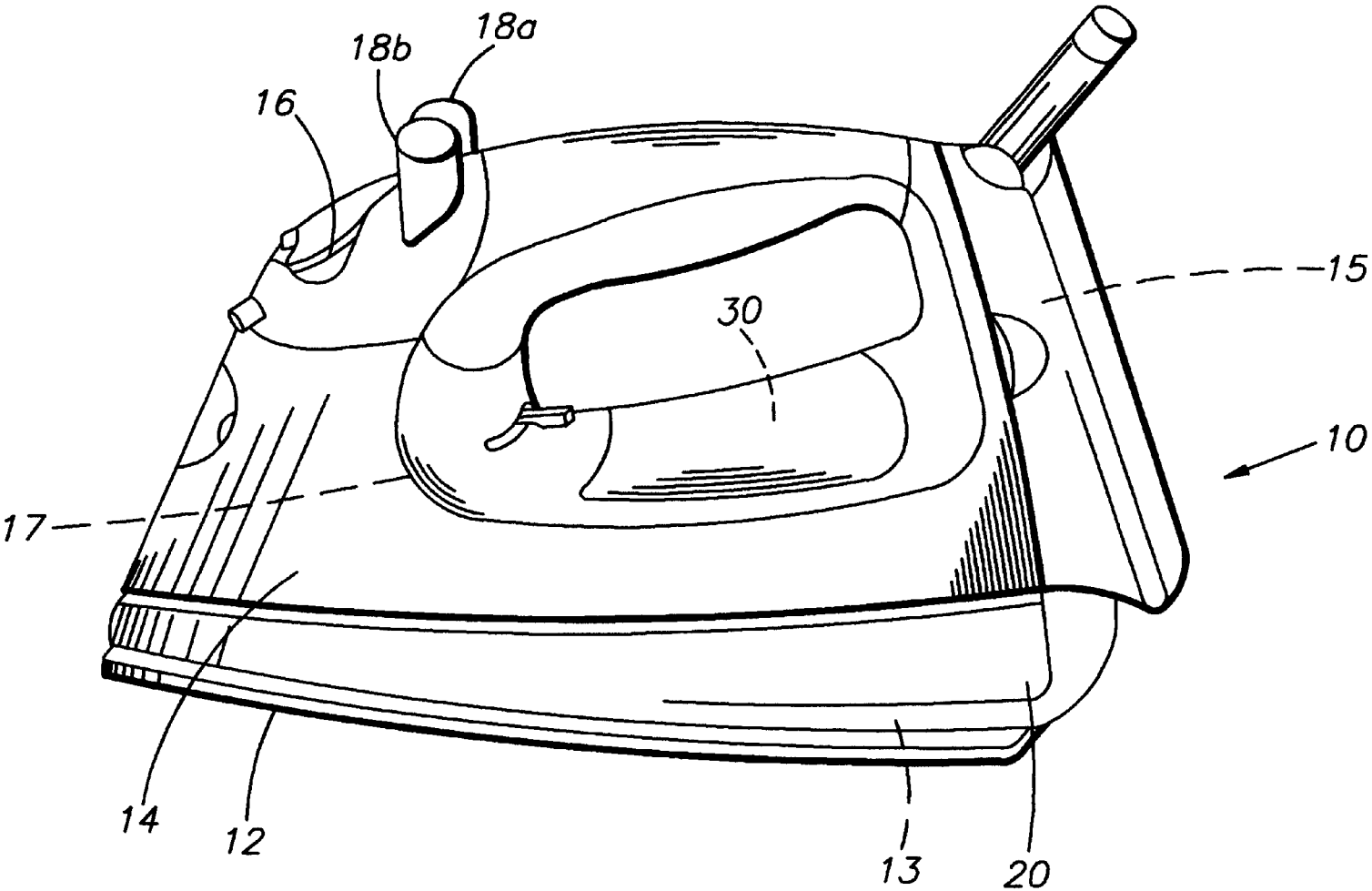
FIG. 1 is a perspective view of an iron incorporating features of the present invention.

Referring to FIG. 1, there is shown a perspective view of an iron 10 incorporating features of the present invention. Although the present invention will be described with reference to the embodiments shown in the drawings, it should be understood that the present invention may be incorporated into various different types of alternate embodiments of irons. In addition, any suitable size, shape or type of elements or materials could be used.

The iron 10 generally comprises a soleplate 12, a housing 14, a temperature control knob 16, a spray button 18*a* and a surge button 18*b*. The soleplate 12 includes a heating element 13 integrally molded therein. The heating element is electrically connected to electronic circuitry 15 in the rear of the iron and a thermostat 17 connected to the temperature control knob 16.

Figure 2:
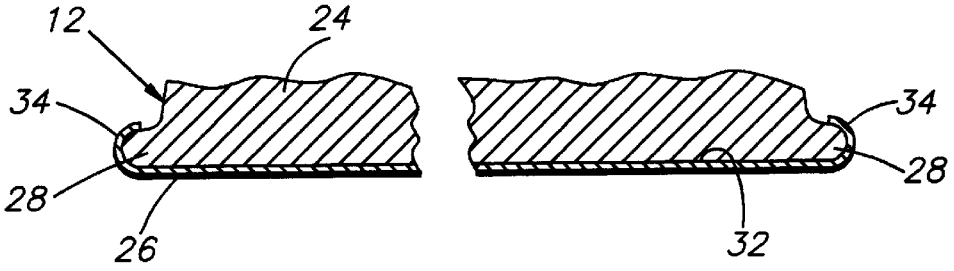
FIG. 2 is a partial cross-sectional view of the soleplate of the iron shown in FIG. 1.
Figure 2A:
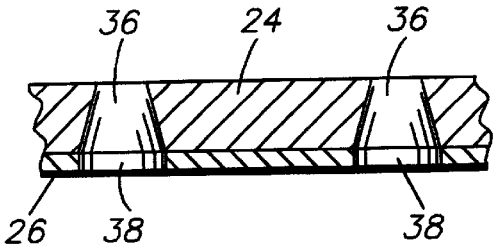
FIG. 2A is a partial enlarged view of the soleplate shown in FIG. 2 showing steam holes through the soleplate.

Referring also to FIG. 2, a partial cross-sectional view of the soleplate 12 is shown. The soleplate 12 generally comprises a first base member 24 and a second wrap member 26. The first member 24 is preferably a unitary cast metal base with a heating element extending therethrough. The second member 26 is preferably a sheet metal member with a thickness of between about 0.020 inch to about 0.030 inch. The base 24 has a lower perimeter rim 28. The second member 26 extends under the bottom surface 32 of the base 24 and has a perimeter section 34 that is wrapped around the perimeter rim 28 of the base 24. More specifically, the perimeter section 34 is preferably roll formed onto the perimeter rim 28. Thus, the second member 26 forms a wrap for the bottom of the base 24. Referring also to FIG. 2A, the base 24 has steam holes 36 that extend to the bottom surface 32. The wrap 26 has steam holes 38 that are aligned with the holes 36. However, the wrap 26 does not extends up into the holes 36, nor is there any direct attachment between the two members 24, 26 at the holes 36, 38. The attachment of the wrap 26 to the base 24 is accomplished solely by the wrapping of the perimeter section 34 of the wrap 26 onto the perimeter rim 28 of the base 24. No additional fasteners or attachments are needed.

Figure 3:
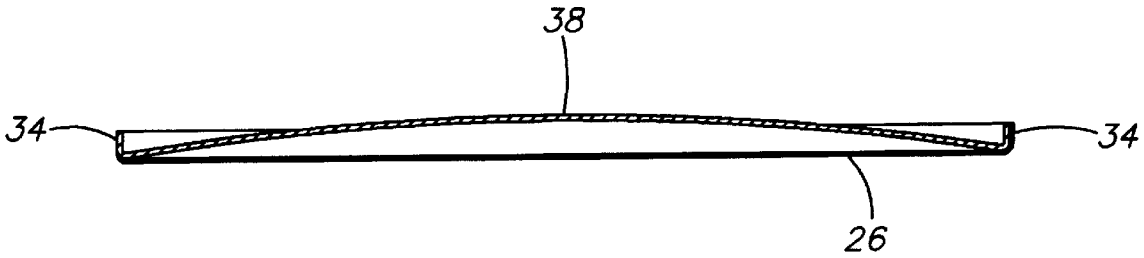
FIG. 3 is a cross-sectional view of the soleplate wrap used on the soleplate shown in FIG. 2.

In order to provide a solid feel of the wrap 26 against the bottom surface 32 of the base 24, the center of the wrap 26 is deformed during its attachment to the base 24. Referring also to FIG. 3, the wrap 26 is shown before it is connected to the base 24. The wrap 26 has a bowed pre-bent section 38. When the wrap 26 is attached to the base 24 the bowed pre-bent section 38 is deflected and flattened against the bottom surface 32 of the base 24. The deformation of the bowed pre-bent section 38 during attachment to the base 24 causes the wrap 26 to be biased against the bottom surface 32 of the base. Thus, the wrap seats firmly and solidly against the bottom surface 32. This provides a solid feel to the soleplate. In an alternate embodiment the wrap need not have a bowed pre-bent section.

This invention allows for the elimination of all secondary operations to the casted soleplate except one; the degating and deflation operation which occurs directly after die casting. Any buffing required for the wrap can be done either by the coating supplier or brought in-house. Also, since the bottom of the soleplate is completely covered, the concern regarding certain non-functional imperfections is eliminated. Therefore, all costs for the secondary operations, as well as scrap and tooling maintenance costs, are either eliminated completely or significantly reduced. Since the wrap covers the bottom of the cased soleplate, a simpler casting design is in order which also reduces design and maintenance costs.

With the wrap being a separate item from the casted soleplate it can be coated with a multitude of coatings, left uncoated for a satin finish look, or have the stock material purchases with a pre-coated finish or coating on it. This flexibility allows a manufacturer to utilize various finishes on an iron in order to meet the needs in the marketplace.

The thickness of the wrap also plays an important role in the construction of the iron. Because the wrap is relatively thin, as compared to various old models which have different types of wraps, and has a high thermal conductivity, the wrap is brought up quickly to temperature. This eliminates the absolute need to place a thermally conductive medium between the casted soleplate and the wrap. In order to ensure a contact between the wrap and the casted soleplate, a concave pre-bend may or may not be put into the wrap. This pre-bend can minimize air gaps allowing quick heating of the wrap.

Further advantages of the relatively thin wrap material coupled with a slight air gap between the wrap and the casted soleplate is that it allows for a more even heat distribution of the outer surface of the wrap. This would allow for a more uniform ironing result and eliminate scorching when the iron is used properly. This same construction also minimizes extreme variations in temperature amplitudes and overshoots seen in typical irons by evenly distributing the temperature over the entire surface of the wrap. This invention also reduces the soleplate development by simplifying the need to fine tune the thermostat, overtemperature limiter, and steam/surge rates to obtain the desired ironing results.

This invention utilizes a wrap with an aluminum substrate metal ranging in thickness from 0.020" to 0.030". This substrate metal comprises the wrap itself and can be left uncoated or coated with a variety of coatings and/or finishes to suit the needs of the marketplace. The wrap can also be fabricated from a variety of precoated stock material wherein the coating is already adhered to the stock material when purchased and is simply stamped out to form the wrap. The wrap is formed from coil stock in either a progressive die or transfer press system. When formed from either of these processes, the wrap has the final shape of the vent holes in it as well as the sides being formed to approximately a ninety degree angle from the bottom surface. The wrap may or may not include a pre-bend formed in the bottom of the wrap which provides a positive load towards the casted soleplate. This pre bend helps to ensure that the wrap fits tightly to the casted soleplate in order to maximize thermal transfer from the casted soleplate through the wrap by minimizing the air gap between the two items. The wrap is attached to the casted soleplate by roll forming the sides of the wrap tightly against a predetermined surface of the casted soleplates outer edge. This process mechanically attaches the wrap to the cased soleplate.

The wrap can also be made of either stainless steel and/or a cold rolled steel. The soleplate can also include a medium, thermally conductive or not, between the wrap and the casted soleplate. If the medium is thermally conductive it may further improve the thermal transfer between the two. Whether the medium is thermally conductive or not, an added benefit would be to take up air space between the wrap and the casted soleplate and dampen any sound transfer which may occur when tapping the bottom of the wrap once it is attached to the casted soleplate. This gives the perception of a solid mass.

Figure 4:
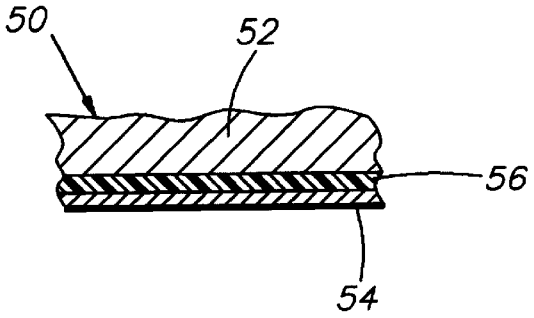
FIG. 4 is a partial enlarged cross-sectional view of an alternate embodiment of a soleplate.

Referring to FIG. 4, a partial cross-sectional view of an alternate embodiment of a soleplate is shown. The soleplate 50 has a base 52, a sheet metal wrap 54, and an adhesive layer 56. The adhesive layer 56 combines with a perimeter wrapping of the wrap 54 on the base 52 to attach the two members 52, 54 together. Preferably, the adhesive layer 56 is a silk screen adhesive that is thermally conductive. In an alternate embodiment, any suitable type of thermally conductive medium could be used between the base and the wrap, such as a gasket.

Figure 5:
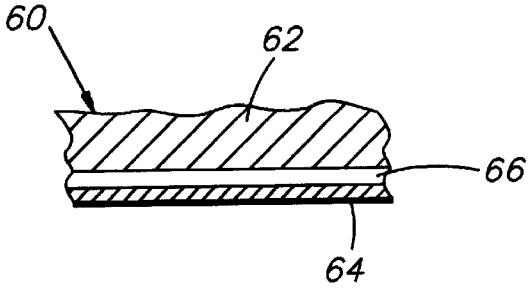
FIG. 5 is a partial enlarged cross-sectional view of another alternate embodiment of a soleplate.

Referring to FIG. 5, a partial cross-sectional view of another alternate embodiment of a soleplate is shown. The soleplate 60 has a base 62, a sheet metal wrap 64, and an air gap 66. The air gap extends between a majority of the area between the two members 62, 64. Spacers (not shown) may also be used. The air gap 66 provides a medium for transfer of heat from the base 62 to the wrap 64 with a predetermined heat transfer.

Figure 6:
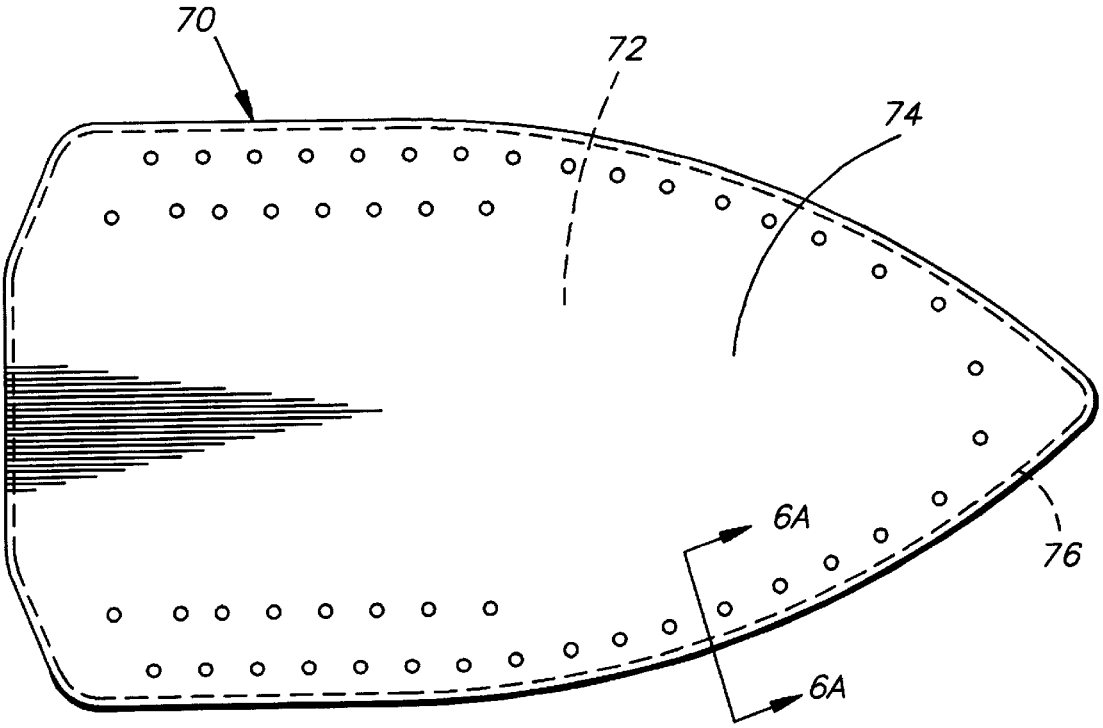
FIG. 6 is a bottom plan view of a soleplate having an air gap as in FIG. 5.
Figure 6A:
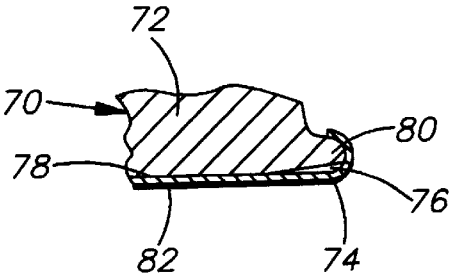
FIG. 6A is a partial cross-sectional view of the soleplate shown in FIG. 6 taken along line 6A—6A.

Referring now to FIGS. 6 and 6A, another alternate embodiment is shown. The soleplate 70 has a base 72, a wrap 74, and a perimeter air gap 76. The wrap 74 is flat against bottom side 78 of the base 72 except at the bottom side of the base 72 at the base's outer perimeter. By providing the perimeter air gap 76, heat transfer from the base's perimeter rim 80 to the wrap 74 can be configured such that the bottom side 82 of the wrap 74 has an even heat distribution. The perimeter air gap 76 need not extend entirely around the perimeter of the soleplate and, may include a multiple separate perimeter air gap sections. Rather than air in the gap 76, another thermally conductive or non-conductive medium could be used, such as adhesive.

Figure 7:
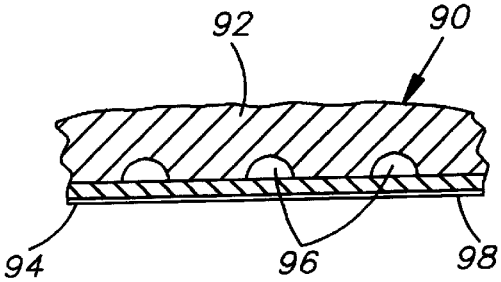
FIG. 7 is a partial enlarged cross-sectional view of another alternate embodiment of a soleplate.

Referring now to FIG. 7, another alternate embodiment is shown. The soleplate 90 has a base 92 and a wrap 94. The bottom surface 94 of the base 92 has been provided with multiple grooves 96. The grooves 96 form air pockets between the two members 92, 94 to provide substantially uniform heat transfer along the entire bottom surface of the soleplate. The wrap 94 includes a coating 98, such as a non-stick coating. Any suitable type of non-stick coating could be used.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In an iron having a housing, a soleplate connected to the housing, and means for heating the soleplate, wherein the improvement comprises:

the soleplate having a unitary base member with heating element therein and a one-piece wrap attached directly to the base member and covering the bottom surface of the base member, wherein the wrap has a bowed pre-bent section that is deflected and flattened against the bottom of the base member when the wrap is attached to the base member, and wherein the pre-bent section is biased against the bottom of the base member, and wherein an air gap is provided between the bottom of the base member and the wrap.

2. An iron as in claim 1 wherein the wrap is a sheet metal member with a thickness of between about 0.02 inch to about 0.03 inch.

3. An iron as in claim 1 wherein the wrap includes a coating along its bottom side.

4. An iron as in claim 1 further comprising a medium between the base member and wrap.

5. An iron as in claim 4 wherein the medium is thermally conductive.

6. An iron as in claim 5 wherein the medium is a silk screen adhesive.

7. An iron as in claim 1 wherein sides of the wrap are roll formed onto sides of the base member.

8. An iron as in claim 1 wherein no additional members are located between the base member and the wrap.

9. An iron soleplate comprising:

a first cast metal member having a heating element extending therethrough;

a second sheet metal member connected to the first member and covering a bottom surface of the first member, the second sheet metal member having a thickness of between about 0.02 inch to about 0.03 inch such that heat from the first member is tranferred quickly to the second member without a thermally conductive medium between the two members; and said second member is directly attached at the first member and wherein an air gap is provided between surface of the first member and the second member.

10. An iron as in claim 9 wherein no additional members are located between the first and second members.

11. An iron as in claim 9 wherein the second member has a bowed pre-bent section that is flattened against the bottom of the first member when the second member is attached to the first member.

12. An iron as in claim 9 wherein the second member includes a coating along its bottom side.

13. In an iron having a housing, a soleplate connected to the housing, and means for heating the soleplate, wherein the improvement comprises:

the soleplate having a first metal member with a heating element therein and a second sheet metal member connected to the first member and covering a bottom surface of the first member, wherein an air gap is provided between the bottom surface of the first member and the second member to provide a predetermined heat distribution from the first member to the second member, wherein the second member has a bowed pre-bent section that is flattened against the bottom surface of the first member when the second member is attached to the first member.

14. An iron as in claim 13 wherein the second metal member is a one-piece sheet metal member having a thickness of between about 0.02 inch to about 0.03 inch and is attached directly onto the first metal member.

15. An iron as in claim 13 wherein the second member has a coating along its bottom surface.

16. An iron as in claim 13 wherein the second sheet metal member has its outer perimeter deformed onto an outer edge perimeter of the first metal member and, wherein the air gap is provided between the two members at an area along a bottom perimeter of the soleplate, the connection at the perimeters being the sole means of connection between the two members.

* * * * *